United States Patent [19]

Moore, III

[11] 4,108,256

[45] Aug. 22, 1978

[54] SLIDING STABILIZER ASSEMBLY

[75] Inventor: Richard G. Moore, III, Enterprise, W. Va.

[73] Assignee: Continental Oil Company, Ponca City, Okla.

[21] Appl. No.: 796,093

[22] Filed: May 12, 1977

[51] Int. Cl.[2] ..... E21B 7/04

[52] U.S. Cl. ..... 175/61; 175/73; 175/325

[58] Field of Search ..... 175/61, 62, 73, 82, 175/325, 321, 323, 83, 76, 295

[56] References Cited

U.S. PATENT DOCUMENTS

| | | | |
|---|---|---|---|
| 1,368,126 | 2/1921 | Elchinko | 175/322 |
| 2,696,367 | 12/1954 | Robishaw | 175/325 X |
| 2,766,013 | 10/1956 | Hertzke | 175/325 |
| 3,131,778 | 5/1964 | Emerson et al. | 175/45 |
| 3,235,017 | 2/1966 | Lynes | 175/321 |

*Primary Examiner*—Ernest R. Purser
*Assistant Examiner*—Richard E. Favreau
*Attorney, Agent, or Firm*—Richard W. Collins

[57] ABSTRACT

Apparatus and method for drilling generally horizontal holes through subterranean coal beds for release of methane gas from the coal beds are described. A sliding stabilizer on a drill rod is selectively positioned to provide elevational control to a rotating drill bit. The stabilizer is keyed to a slot in the drill rod, and lateral offsets in the slot are used to retain the stabilizer in the desired position on the drill rod.

8 Claims, 5 Drawing Figures

SLIDING STABILIZER ASSEMBLY

BACKGROUND OF THE INVENTION

1. Field of the Invention

This invention relates to a method and apparatus for drilling gas relief holes through coal beds, and more particularly to a method and apparatus for maintaining a rotating drill bit along a trajectory parallel to the bedding planes of subterranean coal beds.

The use of rotary drilling to form long horizontal gas relief holes in coal beds is known in the art as a means for degasifying a coal bed in advance of mining. These gas relief holes are either vented or connected to a vacuum source to remove methane from the coal bed. The greatest problem encountered in drilling these gas relief holes is that of maintaining the bit trajectory parallel to the coal bed such that the resulting holes are actually through the coal bed rather than through an overlying or underlying formation.

2. Description of the Prior Art

The state of the art to which the present invention pertains is set forth in detail in a Bureau of Mines Report of Investigations published in 1975 numbered 8097 and entitled "Rotary Drilling Holes in Coalbeds for Degasification", by Cervick et al, available in the U.S. Department of the Interior Library. That report describes the use of rotary drill bits attached to drill rods and maintained in a desired trajectory by a combination of bit thrust, rotational speed and drill rod centralizer spacing. That report further notes that locating a centralizer or stabilizer near the drill bit will cause a slight upward trajectory to the bit with proper drill thrust and bit rotational speed, and further notes that a downward trajectory can be obtained by locating a centralizer several meters behind the bit. However, relocating a centralizer to facilitate a change in bit trajectory due to change in bed dip or to the bit straying out of the coal bed for any reason has previously involved removal of the entire drill string. Such a procedure is time consuming and unproductive. The use of two centralizers as suggested in the report also presents problems.

U.S. Pat. No. 3,131,778 describes a device for changing the direction of a hole being drilled, the device including a housing having a shaped slot with lateral offsets. A drill bit is connected to the housing by a pin movable in the slot. However, the apparatus described in that patent is designed for drilling generally vertical boreholes, and is not suitable for drilling generally horizontal gas relief holes in coal beds.

There has been a continuing need, prior to the present invention, for an improved method and apparatus for controlling the trajectory of horizontal gas relief holes in coal beds.

SUMMARY OF THE INVENTION

According to the present invention, the horizontal trajectory of a rotating drill bit in a coal bed is controlled by use of a stabilizer or centralizer selectively positioned on a drill rod behind a drill bit. The stabilizer may be moved relative to the drill bit without removing the stabilizer from the borehole, thereby saving time and expense when the trajectory of the advancing borehole must be changed to accommodate a change in bed dip of a coal bed being drilled or to prevent the bit from straying out of the coal bed due to bit deviation from any cause.

It is an object of the present invention to provide an improved method and apparatus for drilling generally horizontal gas relief holes in coal beds.

It is a further object to provide such a method and apparatus that will enable an operator to follow the contour of a coal bed when drilling a gas relief hole without the necessity of removing the drill string to effect equipment changes for changing the direction of drilling.

The accomplishment of the foregoing as well as other objects and advantages is obtained by the present invention, and will be apparent from consideration of the following detailed description thereof.

DESCRIPTION OF THE PREFERRED EMBODIMENT

The following detailed description, in conjunction with the drawings, describes the most preferred version of the apparatus and method of the invention.

It is often desirable in degasifying a coal bed to drill a series of gas relief holes for distances of 300 meters and more into the coal bed. Maintaining the bit on a horizontal trajectory parallel to the bedding planes of the coal bed is difficult. The natural tendency of the bit during horizontal drilling is to arc downward due to the forces of gravity. Other factors such as inclusions in the coal bed may also cause the bit to tend to deviate from the plane of the coal bed. It is generally desirable to maintain the bit trajectory within one degree of the plane of the coal bed being drilled through.

Prior to this invention, there were several approaches taken to maintain the bit trajectory along the desired path. The primary factors affecting the direction of drilling are bit thrust and bit rotational speed. As a general rule, decreased thrust and increased rotational speed tend to cause a downward effect on bit trajectory, while increased thrust and reduced rotational speed tend to cause an upward trajectory. It is also known that positioning a stabilizer or centralizer on the drill rod near the drill bit increases the tendency of the bit to move upwardly, while positioning a stabilizer several meters behind the drill bit tends to cause a downward trajectory of the bit. Other factors such as formation hardness, bit type and drill rod weight can affect the trajectory of the hole. An experienced operator must consider the above as well as other factors in controlling the trajectory of the hole. Using prior art procedures, it was sometimes necessary, upon encountering a downward dip in a coal bed, to remove the drill string from the hole and remove a stabilizer from adjacent the bit. This procedure is time-consuming and costly, and it would be desirable to be able to reposition the stabilizer on the drill rod without the necessity of removing the drill string from the hole, particularly after the hole has been drilled a substantial distance into the formation.

Figure 1:
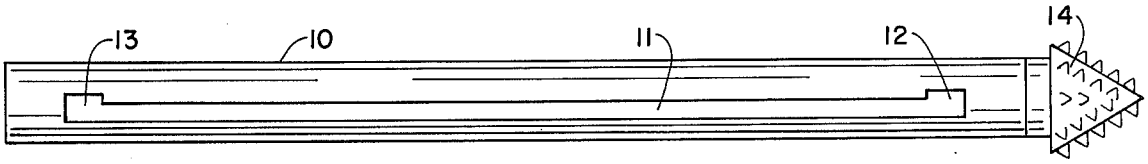
FIG. 1 is a view of a length of drill rod having a slot formed according to the invention.

The apparatus according to the preferred embodiment of this invention will now be described in detail. Referring to FIG. 1, a length of drill rod 10 is shown having a slot 11 formed along the length thereof. Slot 11 inludes a lateral offset 12 at the forward end of slot 11 and a lateral offset 13 at the rearward end of slot 11. The slot 11 may be from three to ten meters long, but preferably is about five to seven meters long. Drill rod 10 includes a drill bit 14 attached at the forward end thereof.

Figure 2:
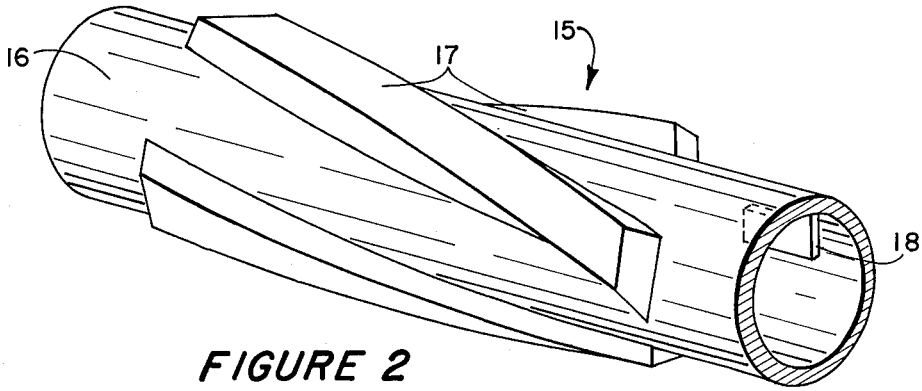
FIG. 2 is an orthogonal projection of a stabilizer in accordance with the invention.

Referring to FIG. 2, a stabilizer 15 including a cylindrical section 16 and helical vanes 17 attached to the outer surface thereof is shown. A key 18 protrudes from the inner wall of cylindrical section 16 to guide the stabilizer 15 along the length of drill rod 10 due to the action of key 18 and slot 11. Key 18 is also adapted to fit in the lateral offsets 12 and 13 upon being positioned adjacent thereto and upon clockwise rotation of drill rod 10. Key 18 can be released from lateral offsets 12 and 13 by counter-clockwise rotation of drill rod 10 allowing longitudinal movement of stabilizer 15 along the length of slot 11.

Figure 3:
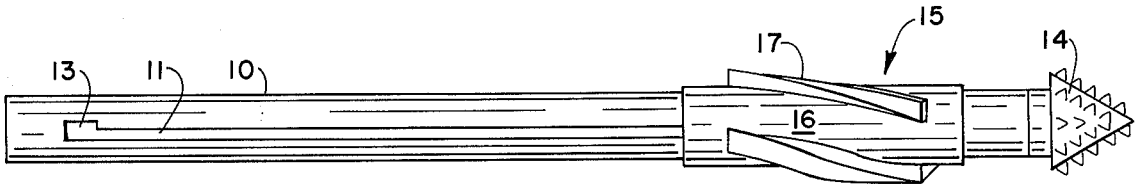
FIG. 3 is a view of a length of drill rod with a stabilizer positioned adjacent a drill bit.
Figure 4:
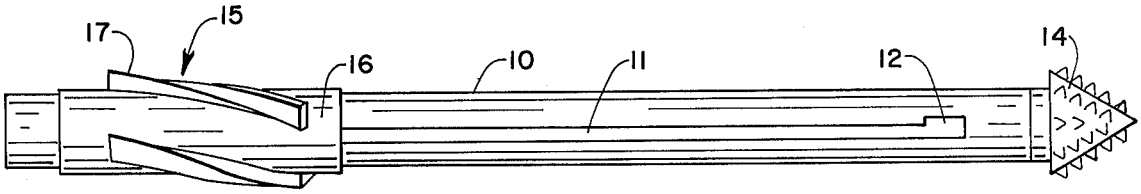
FIG. 4 is a view of a length of drill rod with a stabilizer positioned remote from a drill bit.

FIGS. 3 and 4 respectively illustrate the forward and rearward position of stabilizer 15 on drill rod 10. In the embodiment illustrated, the drill bit 14 is intended for clockwise rotation, such that the rotation of drill rod 10 and the forward thrust will both tend to secure key 18 in lateral offset 12 when the stabilizer 15 is in the position illustrated in FIG. 3. When it is desired to re-position stabilizer 15, drill rod 10 is pulled back slightly, rotated counter-clockwise a fraction of a turn, and then moved forward such that key 18 moves rearwardly relative to slot 11. Continued drilling will cause central stabilizer 15 to work back along the length of drill rod 10 until it reaches lateral offset 13, where it will then be secured in the rearward position. If it is desired to re-position stabilizer 15 from the forward to the rear position prior to any additional drilling, it is only necessary to withdraw the drill rod 10 a distance equal to or slightly greater than the length of slot 11, followed by slight counter-clockwise rotation of the drill string and forward movement of the drill rod 10.

It will be apparent to those skilled in the art that additional flexibility can be designed into the apparatus by providing additional lateral offsets along the length of slot 11 such that the stabilizer could be positioned at any desired distance from the drill bit by appropriate manipulation of the drill rod. Also, the apparatus could be used with only the forward offset 12, as the centralizer would tend to stay in the rearward position during drilling even without the rear lateral offset 13. However, the rear lateral offset 13 is helpful in maintaining the stabilizer in the rearward position under certain operating conditions.

Figure 5:
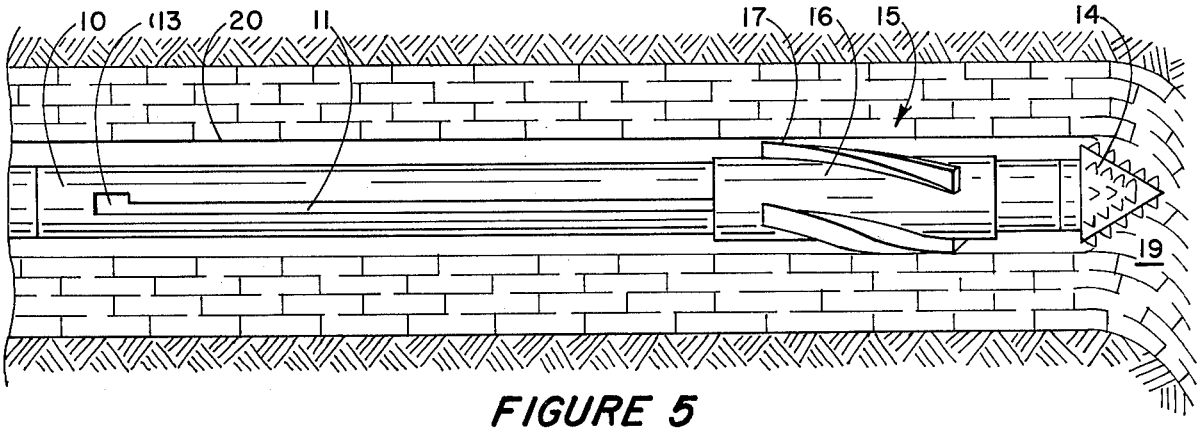
FIG. 5 is a view illustrating the apparatus of the invention in use.

The method in accordance with the invention will now be described, having reference to FIG. 5. In FIG. 5, a borehole 20 is shown extending into a coal bed 19 in a generally horizontal direction. The stabilizer 15 is positioned adjacent bit 14. The coal bed 19 forward of the drill bit 14 is shown dipping downwardly from the horizontal, such that the trajectory of the bit 14 must also dip downwardly to maintain the borehole 20 within the bed 19. To accomplish this, the operator would withdraw the drill rod 10 a distance at least equivalent to the length of slot 11, rotate drill rod 10 slightly counter-clockwise to release key 18 from forward offset 12 in slot 11, and then move drill rod 10 forwardly causing drill rod 10 to advance past stabilizer 15 until the key 18 contacts the rear of the slot 11. Upon resuming drilling, key 18 is secured in rear offset 13, and with the stabilizer 15 located several meters behind bit 14, the trajectory of the borehole 20 will tend to drop, enabling the borehole to be maintained within the coal bed 19 until the bed again resumes a horizontal or upward direction, at which time the stabilizer 15 can again be positioned adjacent the drill bit without the necessity of removing the entire drilling apparatus from the borehole.

The foregoing detailed description of the preferred embodiment of the invention is intended to be exemplary rather than limiting, and it will be appreciated that numerous variations and modifications could be made without departing from the true scope of the invention, which is to be defined by the appended claims.

I claim:

1. A method for drilling a generally horizontal borehole through a subterranean coal bed comprising (a) boring into said coal bed in a generally horizontal direction with a rotatable drill rod having a drill bit at the end thereof, said drill rod also having a longitudinal slot formed therein and having a lateral offset formed in the slot at the end thereof nearest the drill bit, said drill rod further having a stabilizer means mounted thereon for guided movement along said slot, said stabilizer means being maintained in position near the drill bit by the lateral offset during drilling; and (b) upon desiring to effect a downward dip in the trajectory of said borehole, partially withdrawing said drill rod, reversing the direction of rotation of said drill rod to effect release of said stabilizer from said lateral offset, reinserting said drill rod whereby said stabilizer slides toward the rear of said slot, and resuming drilling.

2. The method of claim 1 wherein, after drilling at said downward dip for a distance, the rotation of the drill rod is stopped, the drill rod is partially withdrawn until the stabilizer is adjacent said lateral offset in the drill rod, the drill rod is rotated in the original direction thereby retaining the stabilizer in said offset, and drilling is resumed.

3. Drilling apparatus comprising:

(a) a drill rod;

(b) a stabilizer means concentrically mounted on the drill rod, slidable along a portion of the length thereof, and provided with an inwardly extending key means; and (c) a slot formed along said portion of the length of said drill rod and having a lateral offset at the forward end thereof, said slot being of a length greater than the length of said stabilizer and receiving said key means whereby rotation of said drill rod will cause rotation of said stabilizer at all times while said stabilizer means is concentrically mounted on said drill rod.

4. The drilling apparatus of claim 3 wherein said slot has a lateral offset formed at each end of said slot.

5. The drilling apparatus of claim 3 including a drill bit attached to the forward end of said drill rod.

6. The drilling apparatus of claim 3 wherein said stabilizer comprises a cylindrical member having spiral vanes affixed to the exterior thereof.

7. Apparatus for use in drilling a generally horizontal borehole in a coal bed comprising:

(a) a tubular drill rod member having a longitudinal slot formed on the exterior thereof, said slot being of a length greater than the length of the stabilizer defined below and having a lateral offset formed at the forward end thereof; and (b) a cylindrical stabilizer slidably mounted over said drill rod member, said stabilizer having a key extending inwardly into said slot and selectively positionable in said offset for guiding and selectively positioning said stabilizer relative to said drill rod member and for causing rotation of said stabilizer in response to rotation of said drill rod member at all times while said stabilizer is mounted over said drill rod member.

8. The apparatus of claim 7 wherein said slot has a plurality of lateral offsets spaced along the length thereof.

* * * * *